US005081566A

United States Patent [19]

Crispin et al.

[11] Patent Number: 5,081,566

[45] Date of Patent: Jan. 14, 1992

[54] CONCEALABLE SURGICAL LIGHT

[75] Inventors: George E. Crispin, La Canada-Flintridge, Calif.; Thomas C. Ziolkowski, Greendale, Wis.; Kamlesh N. Soni; Jack W. Nelson, both of Milwaukee, Wis.

[73] Assignee: ALM Surgical Equipment, Inc., Santa Ana, Calif.

[21] Appl. No.: 627,010

[22] Filed: Dec. 13, 1990

[51] Int. Cl.[5] ..... F21V 21/36

[52] U.S. Cl. ..... 362/147; 362/271; 362/365; 362/804

[58] Field of Search ..... 362/147, 148, 269, 271, 362/272, 364, 404, 804, 365

[56] References Cited

U.S. PATENT DOCUMENTS

| | | | |
|---|---|---|---|
| 1,930,081 | 10/1933 | Biller | 240/4.1 |
| 1,938,237 | 12/1933 | Wagenhorst | 240/1 |
| 2,124,050 | 7/1938 | Burner | 240/7.7 |
| 2,428,935 | 11/1950 | Williams | 311/12 |
| 2,859,331 | 11/1958 | Grimes | 240/7.1 |
| 2,905,518 | 9/1959 | Doesken | 312/319 |
| 3,010,013 | 11/1961 | Gunther et al. | 240/1.4 |
| 3,702,928 | 11/1972 | Alger | 240/1.4 |
| 4,204,274 | 5/1980 | Lüderitz | 362/804 |
| 4,233,652 | 11/1980 | Oswald | 362/63 |
| 4,234,908 | 11/1980 | McGee | 362/66 |
| 4,274,686 | 6/1981 | White | 312/27 |
| 4,454,569 | 6/1984 | Maguire | 362/127 |
| 4,511,954 | 4/1985 | Marcus et al. | 362/275 |
| 4,651,258 | 3/1987 | Davis et al. | 362/147 |

*Primary Examiner*—Ira S. Lazarus
*Assistant Examiner*—Richard R. Cole
*Attorney, Agent, or Firm*—Christie, Parker & Hale

[57] ABSTRACT

A concealable surgical light device, such as for a birthing room, has a fixed housing and a single door for supporting the light on one side and decorative ceiling panels on the other side. The door is rotatably attached to the fixed housing. In a closed position of the door, the light is concealed within the ceiling structure, and the decorative panels are flush with the ceiling. In an open position, the light is deployable as it faces into the room. Rotation of the door between the two positions is powered by a motor acting through an actuator and a linkage system. The linkage system includes two first arms rotatably connected to an actuator rod and fixed to a pivot shaft such that extension and retraction of the rod pivot the shaft. Two second arms are fixed to opposite ends of the shaft and pivotally connect to two third arms, in turn connected to the door. Pivoting the shaft rotates the second arms which, in turn, move the third arms up or down to close or open the door.

2 Claims, 6 Drawing Sheets

CONCEALABLE SURGICAL LIGHT

BACKGROUND OF THE INVENTION

The present invention relates to a surgical light that is concealable and, more particularly, to a light supported on a rotatable door for deploying or concealing the light as desired.

Hospitals now routinely use rooms with home-like settings for purposes such as delivery of a newborn baby to provide a natural and reassuring setting for the expectant mother. Hospitals thus use one room for labor, delivery, and recovery (LDR).

As surgical and obstetrical procedures require high intensity lighting, a surgical quality light must be used in LDR rooms. Such lights are typically large and obtrusive, and thus reduce the natural and reassuring atmosphere of the LDR room. To maintain the desired atmosphere, concealable surgical lights have been proposed. One such light is disclosed in U.S. Pat. No. 4,651,258 to Davis et al. This light is mounted in the ceiling structure and concealed by two panels. One panel is hinged to the ceiling structure, and the other panel is hinged to the one panel. It is desirable to have a simpler light-supporting structure having a smooth, quiet operation so as not to disturb the patient.

SUMMARY OF THE INVENTION

The invention is a concealable surgical lighting device, such as for a birthing room. In a preferred embodiment, the device has a single rectangular door for supporting the surgical light on one side and ceiling panels on the other side. The door is hinged to a housing fixed within the ceiling structure. The axis of rotation of the door is on one of its long sides. The mechanism to open and close the door includes an actuator driven by a motor and a linkage system. The linkage system includes two first arms rotatably connected to the actuator's actuating rod and fixed to a rotatable shaft. Extension or retraction of the actuator rod thus rotates the shaft clockwise or counterclockwise. Two second linkage arms are fixed at respective ends of the shaft for rotation with the shaft. These second arms each connect to a third linkage arm which, in turn, connects to the door. These third linkage arms are substantially vertically oriented so as to move downward in response to clockwise rotation of the shaft, and upward in response to counterclockwise rotation. Thus, extension of the actuator rod lowers these third linkage arms to open the door, which rotates about its axis. Retraction of the actuator arm closes the door.

In the closed position of the door, the light is concealed within the ceiling structure, and the ceiling panels are flush with the rest of the ceiling. In the open position, the light is deployable as the door has rotated 90° into the room.

DETAILED DESCRIPTION OF THE PREFERRED EMBODIMENT

The invention is a device for concealing a surgical light. The device includes a door that supports the light and is rotatable between a closed or storage position where the light is concealed in a ceiling or other structure, and an open position where the light is ready for use. The light is supported on the door which, in turn, is rotatably supported in a fixed housing that mounts in the ceiling.

Figure 1:
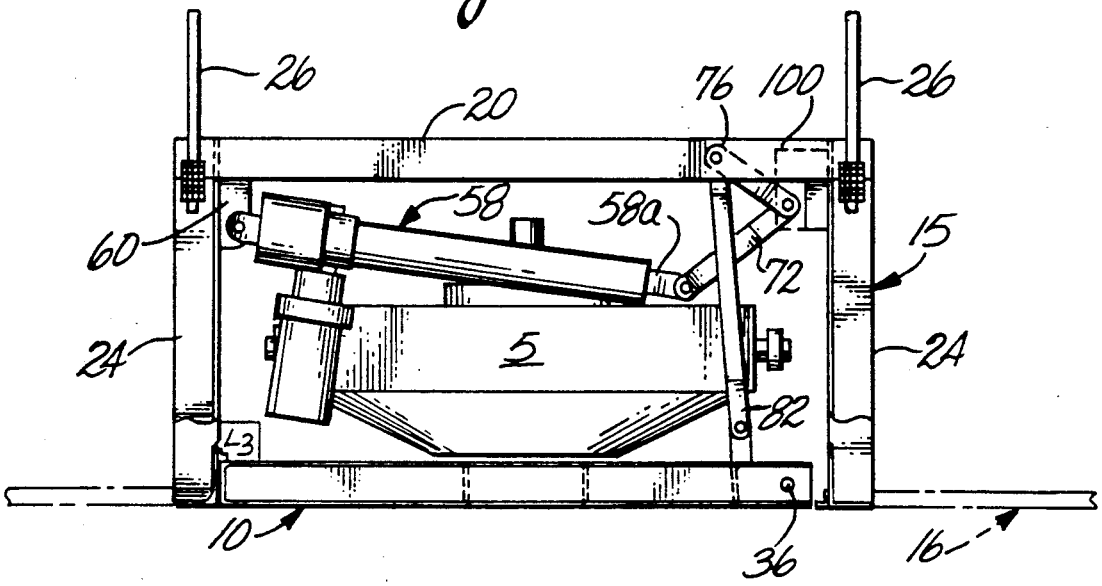
FIG. 1 is a schematic, partially cutaway side view of a concealable surgical lighting device with its door in a closed position in accordance with the invention.

FIG. 1 is a side view of the light, housing, door, and an actuator and linkage system for opening and closing the door. Light 5 is a standard surgical light, such as ALM Surgical Equipment Inc.'s ECL line which includes several retractable lights, such as ECL 152. A rectangular door 10 is shown in the closed position supporting light 5 within a housing or frame 15. The outer side of the door is flush with the ceiling 16 and may contain channels or other means to support decorative ceiling panels that match those of ceiling 16.

Figure 2:
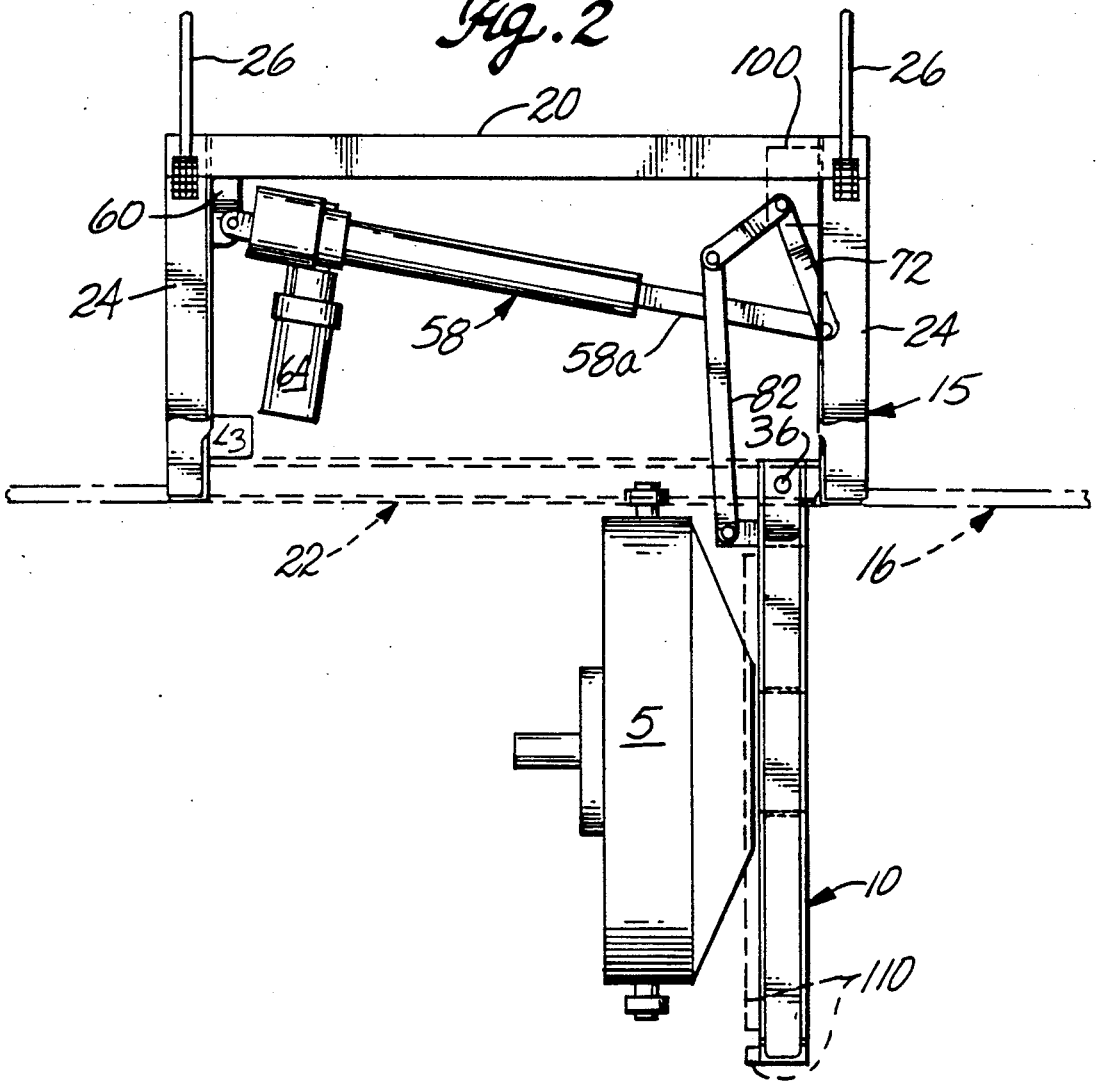
FIG. 2 is a view similar to FIG. 1 with the door in its open position.

FIG. 2 shows door 10 in the open position where it is at, or substantially at, 90° from its closed position.

Figure 3:
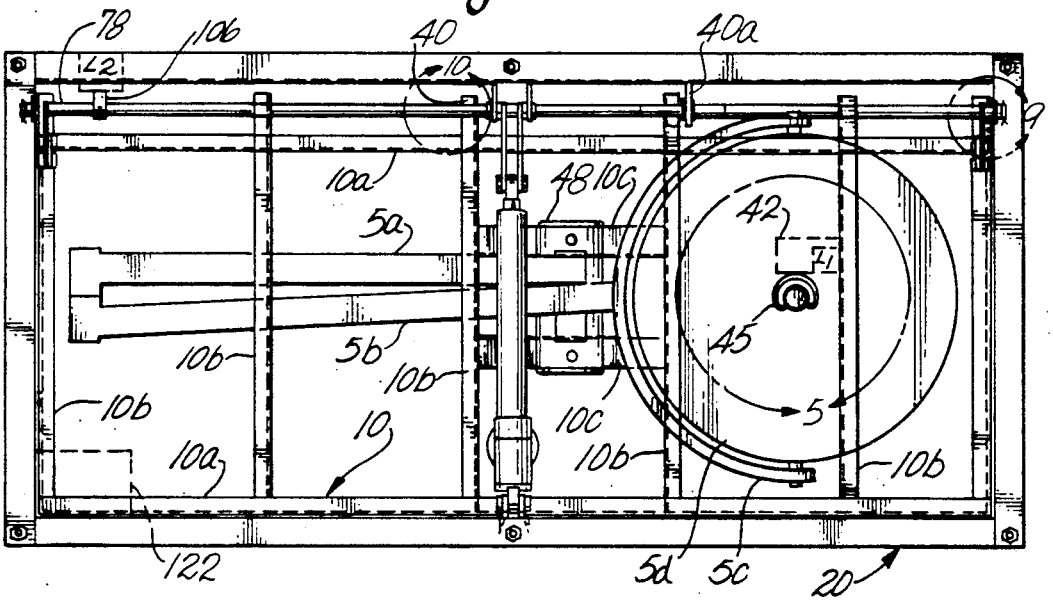
FIG. 3 is a top view of the lighting device of FIG. 1.
Figure 4:
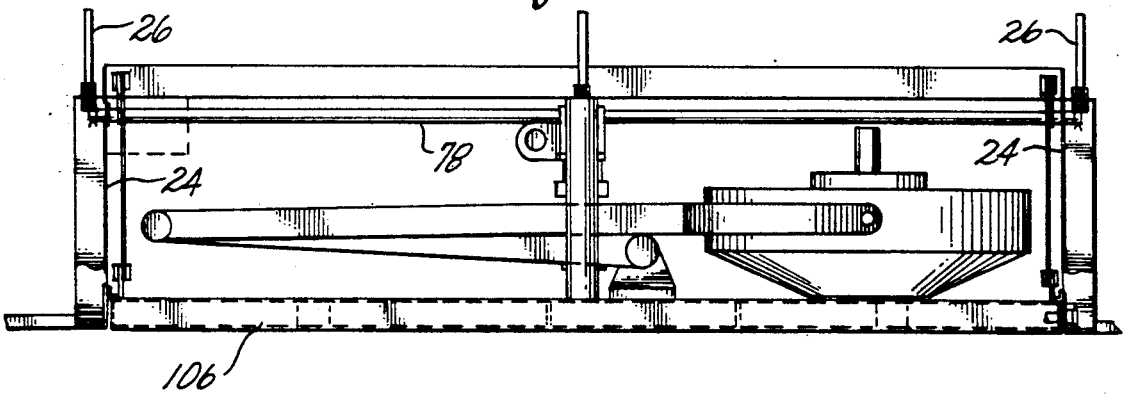
FIG. 4 is a front, elevational view of the device of FIG. 1.

FIGS. 3 and 4 show a top view and a front elevational view of the lighting device, respectively.

The fixed housing 15 is preferably in the form of a rectangular prism having an upper horizontally oriented rectangle 20 and a lower horizontally oriented rectangle 22 connected by four vertically oriented bars 24 at each corner of the rectangles and two vertically oriented bars 24 at the midpoints of the long sides of the rectangles. The upper rectangle 20 is best shown in FIG. 3, and lower rectangle 22, which is substantially identical to the upper rectangle 20, is shown (partly) in phantom in FIG. 2.

The frame 15, as well as the door, are preferably made of steel angle members or square tubing and are welded or bolted together. Housing 15 is fastened in the ceiling structure by suitable means, such as rods 26, anchored to the upper rectangle 20. Additional diagonal bracing may be used as needed.

Rectangular door 10 is defined by two longitudinal steel angles **10*a* (or steel tubing) and cross-members 10*b*, e.g., six of them. The door is slightly smaller than the lower support rectangle 22 and is, when closed, in substantially the same plane as the lower support rectangle 22. The cross-members 10*b* extend beyond the longitudinal member 10*a* on the side of the door connected to a pivot rod 36. The connection to the pivot rod is best shown in the schematic perspective view of FIG. 8**.

Figure 9:
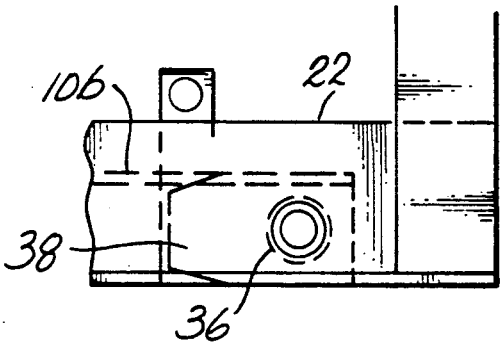
FIG. 9 is a detailed view of an assembly for supporting a pivot rod for the door, taken from with circle 9 in FIG. 3.
Figure 10:
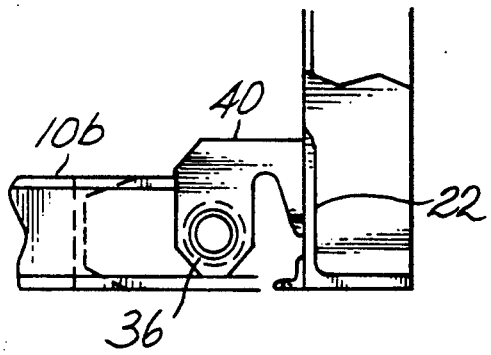
FIG. 10 is a detailed view of an assembly for supporting the pivot rod for the door, taken from within circle 10 in FIG. 3.

Pivot rod 36 passes through apertures formed in the extensions of cross-members 10*b*. The detailed schematic side views of FIGS. 9 and 10 show how the rod 36 connects to frame 15. The two outside cross-members 10*b* connect to the cross-members of the lower support rectangle 22 by means of a bushing 38 fixed to the inner side of rectangle 22. The rod 36 also is supported by a bushing or bushings 40 connected to the lower support rectangle 22 adjacent the ends of one or more of the cross-members 10*b* of door 10.

Light 5 is supported on the inside of door 10 at two places. First, as best shown in FIG. 3, the inner two cross-members 10*b* have two further cross-members 10*c* linking them. A mounting bracket 48 bolts to these cross angle members 10*c* to pivotally support a first arm 5*a* of light 5. The far end of arm 5*a* pivotally attaches to a second arm 5*b*. Arm 5*b* has a substantially semicircular mounting bracket 5*c* attached to its end, and lamp head 5*d* rotatably attaches to the ends of bracket 5*c*.

Figure 5:
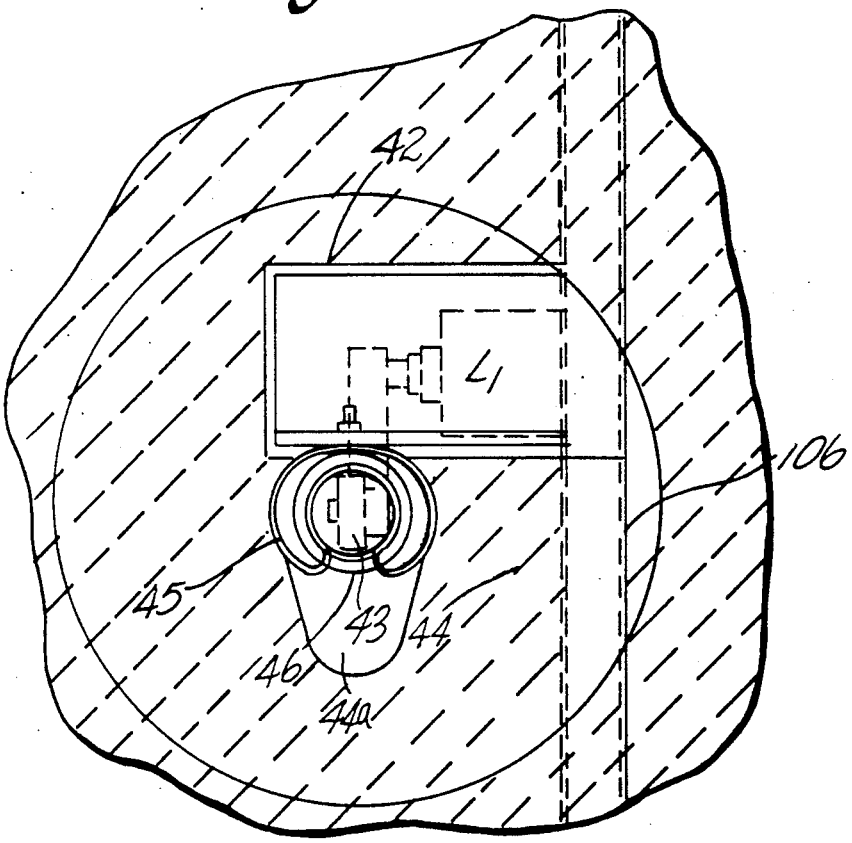
FIG. 5 is an enlarged view of the structure for releasably clamping the light to the door, taken from within circle 5 of FIG. 3.

Second, lamp head 5*d* releasably attaches to door 10, as best shown in FIGS. 3 and 5. One of the cross-members 10*b* supports a mounting bracket 42 to which a limit switch L1, e.g., of the rotary type having an actuator arm 43, attaches. The inside surface of door 10 may be provided with a plastic or metal cosmetic skin 44 which would thus support a C-shaped spring clip 45 for receiving a docking pin 46 connected to lamp head 5*d*. Skin 44 has an appropriate aperture 44*a* into which docking pin 46 (preferably, cylindrical with an enlarged head) may be inserted so that pin 46 can be inserted into clip 45 and removed therefrom, and actuator arm 43 of switch L1 can detect full insertion. It is noted the FIG. 5 is drawn such that, with door 10 open, skin 44 would be oriented substantially vertically. Thus, to remove lamp head 5*d* from spring clip 45, the user simply pulls the lamp head downward to move the pin's enlarged head out from under the spring clip.

Figure 8:
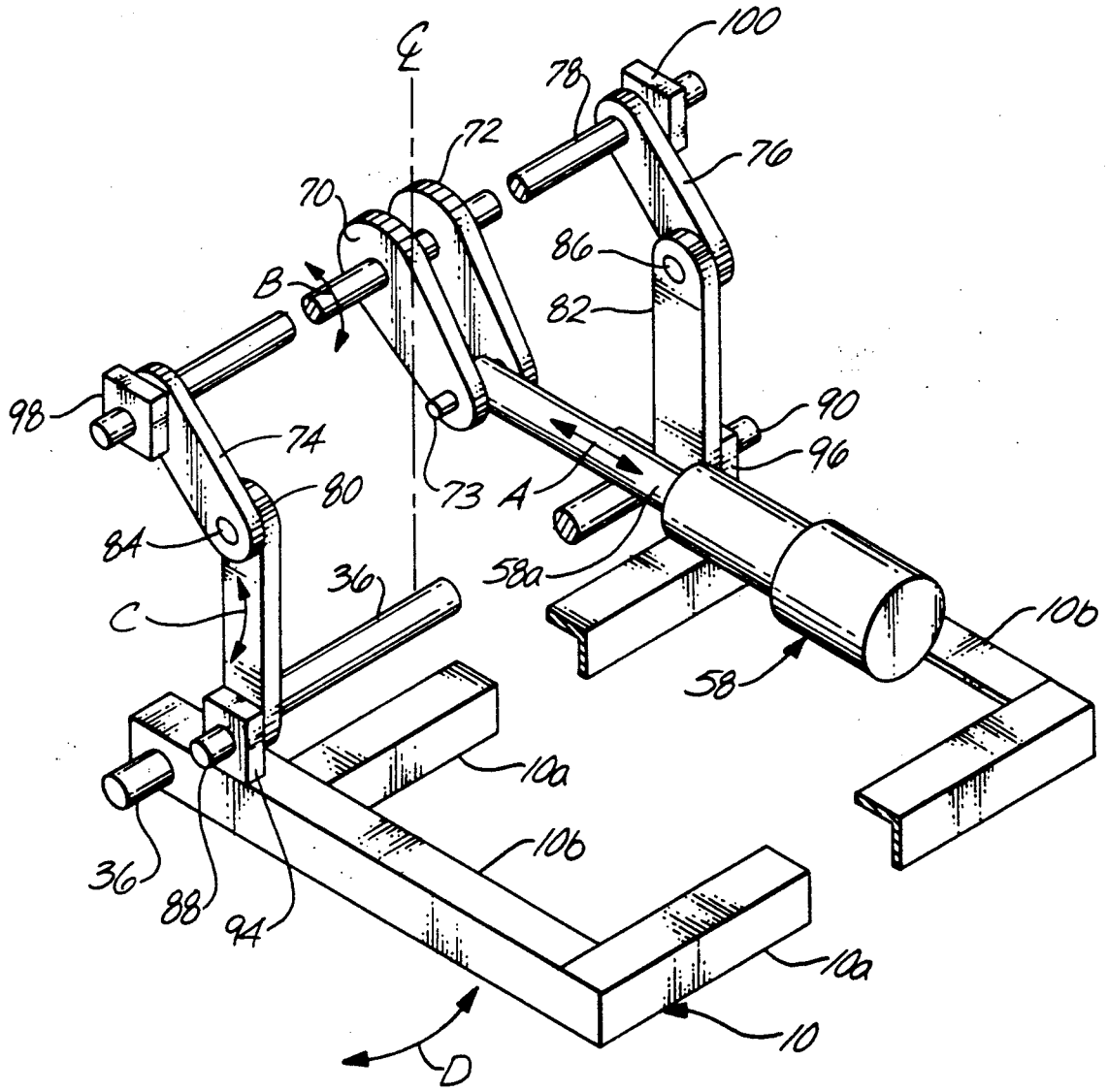
FIG. 8 is a schematic, perspective view of an actuator, linkage system, and the door which the actuator and linkage system serve to open and close.

Next, the motor, actuator, and linkage system for opening and closing the door will be described, with particular reference to the schematic perspective view of FIG. 8, in which the door is shown in its closed position. An actuator 58 mounts by a bracket 60 (e.g., see FIGS. 1 and 2) to the central vertical angle member 24 of frame 15. A motor 64 (not shown in FIG. 8) mounts to the actuator 58 or to the bracket, or is part of the actuator, to drive an actuating arm or rod 58*a*. Suitable actuators are manufactured by Hubbell Specialty Products (e.g., model number MC42-1014 with 8" travel at 0.37" per second) and are well known in the art.

Actuator rod 58*a* extends to open door 10 and retracts to close door 10 through the linkage system. The linkage system is formed by two first linkage arms 70, 72 rotatably connected by a pin 73 to rod 58*a* at one or their ends, and fixed to a pivot shaft 78 at their other ends. The linkage system further includes two second linkage arms 74, 76, also fixed to shaft 78. Two third linkage arms 80, 82 are pivotally connected at their upper ends by pins 84, 86 to the second linkage arms 74, 76, respectively. Lower ends of the third linkage arms 80, 82 are connected by pivot pins 88, 90 to mounting blocks 94, 96 which, in turn, are fixed to door 10 along the outer cross-members 10*b*, respectively. Two additional mounting blocks 98, 100 rotatably support pivot shaft 78 and are fixed to an inner edge of upper rectangle 20 and corner vertical angle members 24, as shown in phantom in FIGS. 1 and 2. Additional support for shaft 78 may be provided by a bushing 40*a* (FIG. 3) attached the same as bushing 40 (see FIG. 10).

The two second linkage arms 74, 76 are preferably fixed to pivot shaft 78 by a Trantorque keyless coupling (model number 6202240) manufactured by Penner Manheim, so that the door open and closed positions can be adjusted to match the limits of the movement of actuator rod 58*a*. In addition, to detect full opening of door 10, an arm 106 is fixedly attached to the shaft 78, and a limit switch L2 having a rotatable actuator is attached to frame 15, such as shown in FIG. 3, to be contacted by arm 106 upon the proper amount of rotation of shaft 78 necessary to fully open door 10.

To open door 10, when the motor turns on, actuator arm 58*a* extends (arrow A) causing first linkage arms 70, 72 to rotate clockwise (arrow B) with respect to the axis of pivot shaft 78. Shaft 78 thus rotates with these first linkage arms, turning second linkage arms 74, 76 clockwise and, consequently, moving third linkage arms 80, 82 generally downward (arrow C). In turn, door 10 rotates clockwise (arrow D) about pivot rod 36 until reaching approximately 90° at the point of maximum extension of actuator rod 58*a*. At this point, arm 106 contacts switch L2.

Door 10 closes by retracting arm 58*a* to rotate pivot shaft 78 counterclockwise and thus lift third linkage arms 80, 82. Door 10 rotates to the closed position, which is detected by limit switch L3 (FIG. 2) mounted to frame 15. In accordance with an additional aspect of the invention, door 10 has three serially connected tapeswitches 110 (FIGS. 2 and 6) along the edges of its inside surface, except for the edge adjacent rod 36. During closure of the door, any contact with the tapeswitches will open a normally closed relay so as to reverse motor 64 and thus cause actuator 58 to stop door 10 and reopen it to the fully-open position.

Figure 6:
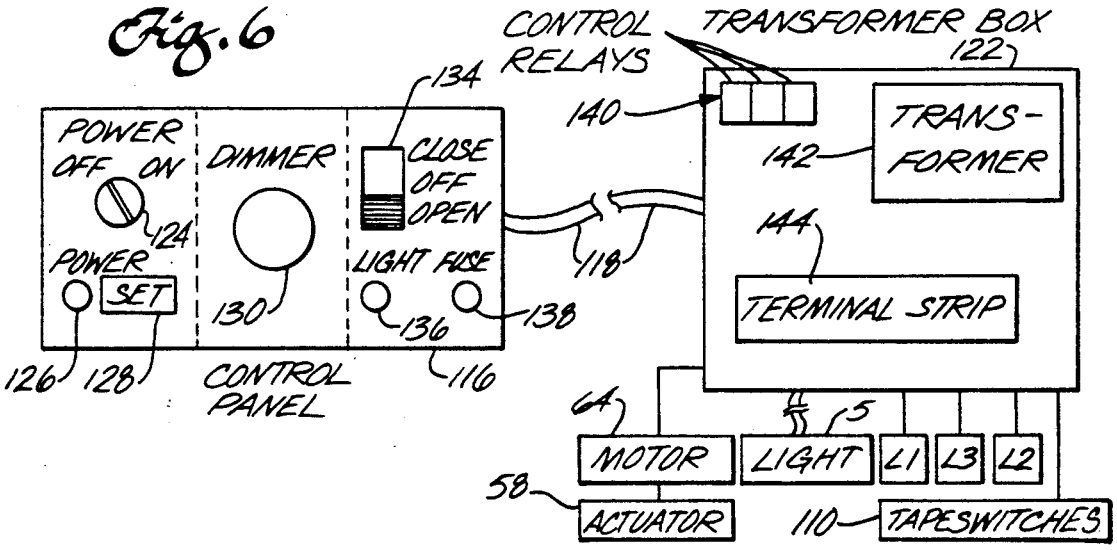
FIG. 6 is a block diagram of a control panel for controlling operation of the light and a transformer box and its connections to electrical devices used in the device of FIG. 1.
Figure 7:
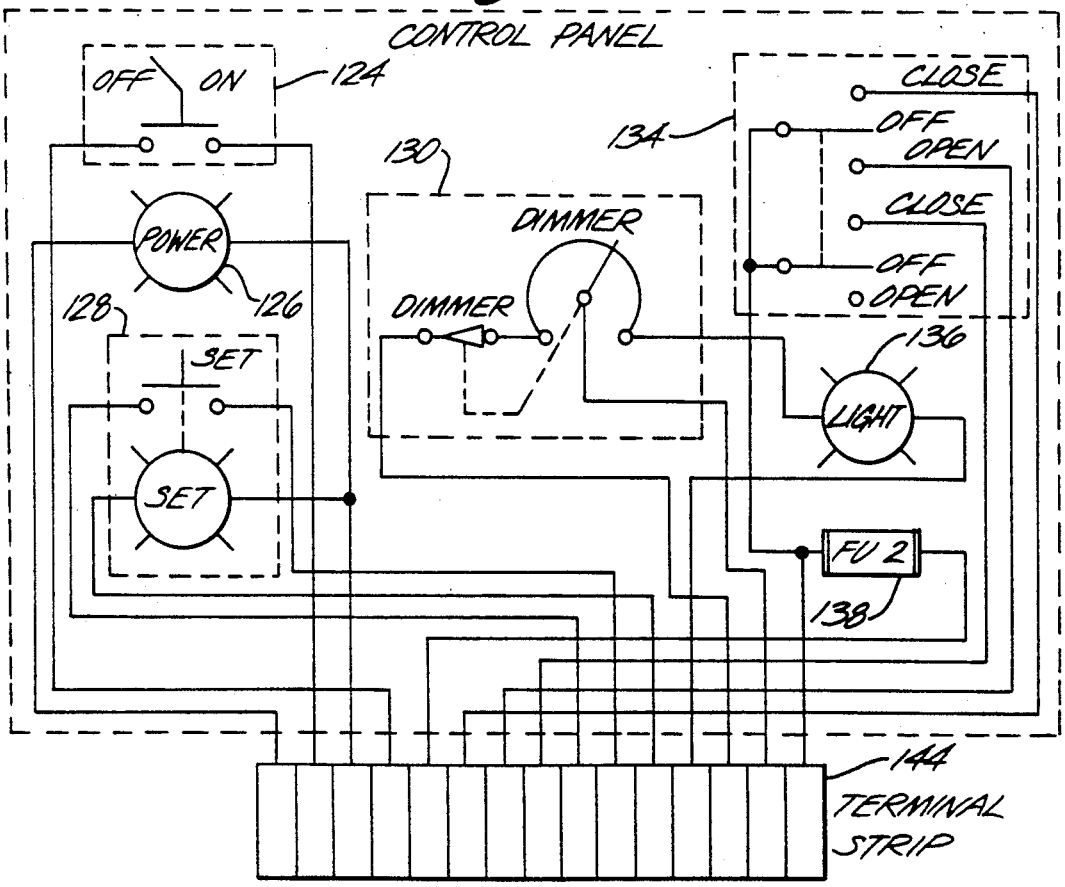
FIG. 7 is a detailed circuit diagram of the control panel of FIG. 6 and a terminal strip in the transformer box.

FIGS. 6 and 7 show electrical connections for a control panel, transformer box, and the electrical components of the lighting device, including actuator 58, motor 64, light 5, limit switches L1, L2, L3, and tapeswitches 110. To operate the lighting device, there is a control panel 116 which is preferably located remote from the frame 15 and connected by means of a conduit wire 118 to transformer box 122. The control panel 116 has a power on/off switch 124, a power-on indicator light 126, a set push button 128, which includes an indicator light, a dimmer switch 130, a three-way open, close, and off control rocker switch 134, with an indicator light 136, and a fuse 138. Transformer box 122 contains control relays 140, a transformer 142, and a terminal strip 144.

OPERATION OF THE LIGHT

Normally, the door is closed. To open the door, the user turns on power switch 124 on the control panel 116 so the "power" indicator light 126 and "set" push button light 128 turn on. Depressing "set" 128 initializes the tapeswitches 110, and the "set" light turns off. (In the preferred embodiment, the door 10 will not close unless the tapeswitches 110 are initialized. However, depressing the "set" button 128 can wait until the door 10 is to be closed.)

Because of limit switch L1, the light 5 will not come on until it is undocked, even if the dimmer switch 130 has been left on. So, the dimmer switch can be set at any time. Pressing the rocker switch 134 to the "open" position now turns on the motor, which causes the actuator to extend rod 58*a* to open the door through the linkage system.

The door stops when open to 90° due to the limitations of the actuator. To deploy the light, the user simply pulls its yoke down, and this removes the pin 46 from the spring clip 45, releasing limit switch L1 to allow the light to be turned on and to prevent closure of the door. Releasing switch L1 also turns on the indicator "light".

To close the door, it is not necessary to turn off the dimmer switch. Turning off this switch, or properly docking the light 5, will turn off the light, and the indicator "light" and also allow power to flow to the motor. The circuitry is also such that the door cannot be closed unless the tapeswitches have been initialized. Further, the rocker switch must be moved from "off" or "open" to "close". This prevents the door from automatically closing when the tapeswitches are initialized. Once initialized, the door will close in response to moving the rocker switch to "close". If the tapeswitches (e.g., covered by safety bars) contact an obstruction (e.g., someone's arm), power to the motor reverses to fully reopen the door.

The tapeswitch "set" light will come on to remind the user to depress "set" again to reinitialize the tapeswitch circuit. Now, the door may be closed as before, i.e., by moving the rocker switch from "open" or "off" to "close".

When the door completes closure, limit switch L3 is tripped. It is preferable at this point to turn the rocker switch to "off" and the power selector to "off".

Switch L2 ensures proper operation of light 5. That is, the light 5 will not turn on unless limit switch L2 has been engaged.

The above-described embodiment is only illustrative of the invention, which is defined by the appended claims. For example, a cosmetic skin 44 is not required, but if provided, it may also be provided with access doors to be able to repair components of the device, even if the door 10 cannot open.

What is claimed is:

1. A concealable surgical light device for installation in a structure having an exterior surface defining a room, the device comprising:

(a) a housing fixedly installed in the structure;

(b) a door having a first side including means for mounting a surgical light and a second side;

(c) means for supporting the door in the housing for rotation with respect to the housing between a closed position in which the second side of the door is substantially flush with the exterior surface of the structure and the light is concealed, and an open position in which the door is at substantially 90° to its closed position such that the light faces into the room; and (d) drive and linkage means for rotating the door between the closed and open positions, wherein the linkage means comprises a linearly extendible and retractable actuator rod, first linkage means for linking the rod to a shaft so as to rotate the shaft in response to extension and retraction of the rod, second linkage means connected to the shaft for rotation with the shaft, and third linkage means connected to the door and the second linkage means for moving upward or downward in response to rotation of the second linkage means to rotate the door between the open and closed positions.

2. The device of claim 1, wherein the second linkage means comprises two links fixed to opposite ends of the shaft, and the third linkage means comprises two links each connected to a respective one of the two links of the second linkage means.

* * * * *